US010099151B2

(12) United States Patent
Liang

(10) Patent No.: US 10,099,151 B2
(45) Date of Patent: Oct. 16, 2018

(54) SPIN AXIS CONTROLLABLE SPINNING TOP ASSEMBLY

(71) Applicant: Owen S. G. Liang, Eastvale, CA (US)

(72) Inventor: Owen S. G. Liang, Eastvale, CA (US)

( * ) Notice: Subject to any disclaimer, the term of this patent is extended or adjusted under 35 U.S.C. 154(b) by 54 days.

(21) Appl. No.: 14/290,957

(22) Filed: May 29, 2014

(65) Prior Publication Data

US 2015/0343318 A1 Dec. 3, 2015

(51) Int. Cl.
*A63H 1/00* (2006.01)

(52) U.S. Cl.
CPC ..... *A63H 1/00* (2013.01)

(58) Field of Classification Search
CPC ..... A63H 1/00; A63H 1/02; H01F 7/0236; H02K 7/09; F16C 32/0406–32/0497; F16C 39/06–39/006
See application file for complete search history.

(56) References Cited

U.S. PATENT DOCUMENTS 791,080 A * 5/1905 Davenport ..... A63H 33/40 446/217
896,628 A * 8/1908 Davenport ..... A63H 33/40 446/217
960,715 A * 6/1910 Schneider ..... A63H 33/26 446/138
1,005,853 A * 10/1911 Lewis ..... A63H 33/26 273/456
1,411,962 A * 4/1922 Dupell ..... A63H 13/20 446/200
1,411,974 A * 4/1922 Mann ..... A63H 1/00 273/456
1,629,135 A * 5/1927 Vinson ..... A63H 1/08 446/202
3,337,984 A * 8/1967 Tomasello ..... A63H 1/00 446/138

(Continued)

FOREIGN PATENT DOCUMENTS

CN 202581075 U 12/2012
FR 1000548 2/1952

(Continued)

OTHER PUBLICATIONS

"Spinning tops on a gentle incline—the question": David Featonby, Physics Education, Mar. 2015, pp. 256-257.*

(Continued)

*Primary Examiner* — John E Simms, Jr.
*Assistant Examiner* — Urszula M Cegielnik
(74) *Attorney, Agent, or Firm* — Cheng-Ju Chiang

(57) ABSTRACT

A spinning top assembly comprises a base generating magnetic attraction to magnetic responsive material. A face of the base is defined at a side of the base. The base is capable of turning to more than one orientation with respect to gravity. The spinning top assembly further comprises a top comprising a body made of magnetic responsive material. A shaft extends from the body to the face of the base so as to engage on the face of the base. The top spins on the face of the base via the shaft after the top is balanced on the base and is in a stable balanced spinning condition regardless orientation of the base being one of the more than one orientation thereof with respect to gravity.

10 Claims, 12 Drawing Sheets

(56) References Cited

U.S. PATENT DOCUMENTS 3,466,796 A * 9/1969 Greenblatt ..... A63F 9/16 273/109
3,876,205 A * 4/1975 Drohomirecky ..... A63H 1/00 124/4
3,879,887 A * 4/1975 Brookson, Jr. ..... A63H 1/06 446/220
3,964,190 A * 6/1976 Leo ..... F16C 39/063 40/412
4,382,245 A * 5/1983 Harrigan ..... H01F 7/0236 181/5
4,408,413 A * 10/1983 Hyland ..... A63F 9/16 446/138
4,575,346 A * 3/1986 Ogawa ..... A63H 1/06 446/135
4,753,623 A * 6/1988 Krut ..... A63H 33/26 335/306
4,891,031 A * 1/1990 Beaudry ..... A63H 11/14 446/256
5,182,533 A * 1/1993 Ritts ..... A63H 33/26 310/90.5
5,404,062 A * 4/1995 Hones ..... H02N 15/00 310/90.5
5,506,459 A * 4/1996 Ritts ..... A63H 1/00 310/90.5
5,883,454 A * 3/1999 Hones ..... F16C 32/0436 310/90.5
6,781,270 B2 * 8/2004 Long ..... A63H 33/26 310/152
6,937,125 B1 * 8/2005 French ..... F16C 39/063 335/296
7,066,778 B2 * 6/2006 Kretzschmar ..... A63H 33/046 446/124
7,275,974 B2 * 10/2007 Perry ..... A63H 33/26 273/109
7,552,877 B2 * 6/2009 Grant ..... B05B 3/006 239/17
7,671,712 B2 * 3/2010 Elliott ..... H01F 7/0236 335/209
2006/0214756 A1 * 9/2006 Elliott ..... H01F 7/0236 335/306
2007/0210886 A1 * 9/2007 Gerber ..... H01F 7/0294 335/306
2009/0184595 A1 7/2009 Farber
2011/0057754 A1 * 3/2011 Kellum ..... H01F 7/0236 335/284
2013/0324005 A1 12/2013 Ferreyra et al.

FOREIGN PATENT DOCUMENTS

GB 2425576 A * 11/2006 ..... F16C 32/0429
RU 2215567 C1 11/2003

OTHER PUBLICATIONS

"Spinning tops on a gentle incline—the answer": David Featonby, Physics Education, May 2015, pp. 391-392.*
"3D Rigid Body Dynamics—Tops and Gyroscopes": J. Peraire, S. Widnall, 16.07 Dynamics, Massachusetts Institute of Technology, Fall 2008, Version 2.0.*
"Surprising Behavior of Spinning Tops and Eggs on an Inclined Plane": Rod Cross, The Physics Teacher, Jan. 2016, pp. 28-30.*

* cited by examiner

SPIN AXIS CONTROLLABLE SPINNING TOP ASSEMBLY

BACKGROUND OF THE INVENTION

1. Field of the Invention

The present invention relates to a spinning top assembly, particularly relates to a spin axis controllable spinning top assembly capable of changing spinning orientation thereof under proper control to defy gravity when spinning at any orientation thereof. Especially, a spinning top assembly in accordance with the present invention is capable of continuing changing orientation of a defined spin axis thereof under proper control when an orientation thereof varies from a regular horizontal spinning orientation during spinning of the spinning top assembly as desired.

2. The Related Arts

A rotation axis or spin axis is an imaginary line around which a three-dimensional object rotates or spins. Every rotating object such as a motor, wheel, gyroscope, or spinning top must have a defined rotation axis. To hold the rotation axis of a rotating object at desirable orientation, it requires least two anchored points along the rotation axis. Almost all manmade rotating objects are able to satisfy these two simple requirements except a spinning top. Two bearings on each side of a rotor are the anchored points for a rotating object such as an electrical motor or gyroscope. Positions of these two bearings dictate the orientation of the rotors. In contracting, a spinning top only has one contacting point or a single solid anchored point, manipulating orientation of its spin axis was never possible in any past prior arts. The spinning top could not have more than one solid contacting point to be function as spinning top. This uncontrollable spin axis of the spinning top does not mean its rotation axis acts randomly. For some reason, the spin axis of the spinning top always wants to go a vertical orientation no matter where its starting orientation is. The spinning top moves from its tiled position to an upright position by precession or wobbling. In another word, the spinning top could not hold still at any tilted position; it will become precession until reach the upright position.

The main structural difference between a gyroscope and spinning top is the number of the supporting points for their spinning shafts or spin axis. Spinning tops have only one supporting point while a gyroscope has two supporting points. Therefore the orientation of a gyroscope is decided by the locations of the two supporting points. Obviously, the orientation of a spinning top is uncontrollable due to there is only one supporting point. There is no second supporting point to confine the spinning axis of the spinning top.

Unlike a gyroscope, the spinning top is only limited to play at its upright or vertical orientation. Any external force for changing its vertical orientation would cause the spinning top starting precession. The purpose of this procession of the spinning top is to move back to the vertical position again. In another word, the spinning top could not hold stable at any tilt position. Natural limitation of a spinning top is restricted to such upright orientation. To break such limitation of the spinning top and to stabilize the spinning top at any orientation thereof becomes a main issue to be addressed.

Especially, according to a personal explanation theory created by the inventor of the present invention, the spinning top deals with two kinds of forces, a falling force and a standing force. Spinning of the spinning top creates the standing force which is always opposite to the falling force. In all previous arts, since the falling force is the gravity all the time, the direction of standing force, which is opposite to the gravity, always goes up. As a result, no other direction for the standing force is considered to be possible.

Hence, based on a new spinning top theory of the inventor of the present invention, a novel design or method to confine orientations of a spinning top at any directions as desired is considered and provided in the present invention as described hereinafter.

SUMMARY OF THE INVENTION

The primitive object of the present invention is breaking through the natural limitations of a spinning top as depicted above in previous arts. The present invention presents a way and a method to control a spin axis of spinning top at any orientation thereof as desired. More specifically, the spin axis of the spinning top is capable of holding at horizontal direction, downward vertical direction or any other orientation between 0 to 360 degrees with respect to gravity.

Another primitive objective of the present invention is providing a novel design to reveal a novel method to guide spinning orientation of a spinning top. The present invention is base on the personal spinning top physic theory of the inventor. More specifically, a spinning axis of a spinning top becomes controllable even though there is only single solid supporting point for the spinning top. In present invention, a falling force of the spinning top is a magnetic force or attraction force from a base of a spinning top assembly in accordance with the present invention. Meanwhile, a standing force for the spinning top should be the opposite of the magnetic force of the base. Since a direction of the magnetic force is changeable or controllable by changing orientations of the base, the direction of the standing force for the spinning top becomes also controllable.

In details, the spinning top is controlled by two kinds of forces, one is a falling force and the other one is a standing force. Spinning of a spinning top creates the standing force which is always opposite to the falling force. When the gravity is the sole falling force for the spinning top, the standing force has to always go up. No other direction is possible since the direction of the gravity is always same in the real world. The above clearly explains why spinning tops of the prior art can only stand up and hold vertically. In order to manipulate a direction of a standing force created by spinning tops, a falling force for spinning tops has to be artificially controllable. As provided in the present invention, a magnetic force is used as the falling force, and the spinning top is under influence of such magnetic force which is used to substitute the gravity force in prior art. Changing directions of the magnetic force will alter directions of standing forces which is always against the falling force. Clearly, directions of the standing force decide orientations of spinning tops. Hence, the orientations of the spinning top can be easily controlled in the present invention. Besides, the falling force, either the magnetic force of the present invention or the gravity of prior art, makes a spinning top tending to fall when a spinning speed of the spinning top is not high enough. Understandably, a fallen spinning top is destined to have more than one solid contacting point, mostly two contacting points with its spinning base, regardless of its current orientation. If the spinning top is in an upright position with more than one solid contacting point with its spinning base, the spinning top is still considered as being fallen. A fallen spinning top is also considered as a non-working spinning top. On the contrary, standing of a spinning top means the spinning top works with only one solid contacting point on its spinning base. A spinning top has to spin fast enough so as to generate a stronger standing force. As long as the spinning top has only one solid contacting point with a spinning base during its spinning, it is still considered as standing or working regardless of its orientations and the spinning base it is placed on. In this situation, standing of the spinning top means standing on its spinning base rather than standing under the gravity influence.

According to an aspect of the present invention, a spinning top assembly comprises a base generating magnetic attraction to magnetic responsive material. A face of the base is defined at a side of the base. The base is capable of turning to more than one orientation with respect to gravity. The spinning top assembly further comprises a top comprising a body made of magnetic responsive material. A shaft extends from the body to the face of the base so as to engage on the face of the base. The top spins on the face of the base via the shaft after the top is in a stable balanced spinning condition regardless orientation of the base being one of the more than one orientation thereof with respect to gravity.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENT

Figure 1:
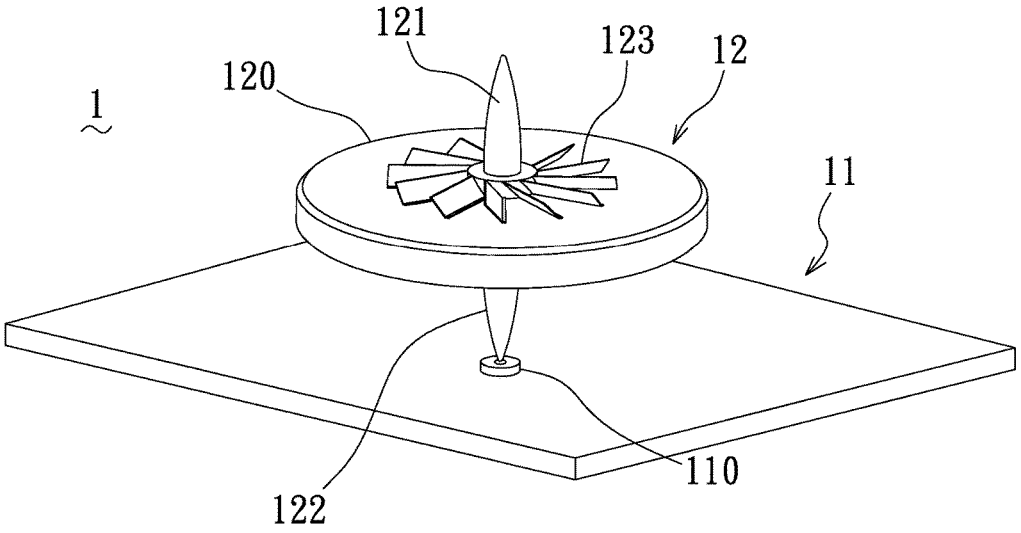
FIG. 1 shows a schematic perspective view of a spinning top assembly in accordance with a preferred embodiment of the present invention.

With reference to FIG. 1 in a static upright position without spinning under an ideal circumstance without gravity falling force or other falling force such as magnetic falling force, a spin axis controllable spinning top assembly 1 in accordance with a preferred embodiment of the present invention comprises a base 11 and a top 12. The base 11 of the spinning top assembly 1 is made of magnetic material and is capable of providing magnetic attraction to the top 12. Alternatively, the base 11 can be made of magnetic responsive material. The base 11 is preferably a flat platform in the preferred embodiment. Preferably, the base 11 can be a disc shape. A spin seat 110 is defined at a central area of a flat face of the base 11 for sustention of spinning of the top 12 thereon to avoid unnecessary movement of the top 12 away from a center of the base 11. In another embodiment other than the preferred embodiment, no spin seat 110 is set on the flat face of the base 11. Further in the preferred embodiment, a magnetic intensity provided by the base 11 is preferably 35,000,000 Gauss so as to be considered as being larger than a scale of gravity, and a thickness of the base 11 is preferably ⅛ inches.

The top 12 comprises a disc wheel-like body 120, and the body 120 is made of magnetic responsive material, such as ferrous metal. Alternatively, the body 120 can be made of magnetic material when the base 11 is made of magnetic responsive material. An upper shaft 121 and a lower shaft 122 are integrally formed with the body 120, and respectively extend away from the body 120 in opposite directions. The upper shaft 121 is aligned with the lower shaft 122 so as to commonly define a spin axis for the body 120. An end of the lower shaft 122 is either disposed on the spin seat 110 of the base 11 for spinning of the top 12 as shown in FIG. 1, or simply disposed on the flat face of the base 11 as stated above in the another embodiment. A driving structure 123 is defined on a surface of the body 120 facing the upper shaft 121. Alternately, the driving structure 123 can be defined on a surface of the body 120 facing the lower shaft 122. In the preferred embodiment, the driving structure 123 comprises a plurality of fins integrally formed with the body 120. The plurality of fins are ribs arranged to be equally distributed around a predefined circle on the surface of the body 120. At least one fin of the plurality of fins will be driven without any interrupt due to arrangement of the plurality of fins when only one driving source (in detail as below) is provided and the top 12 starts to spin.

Figure 4:
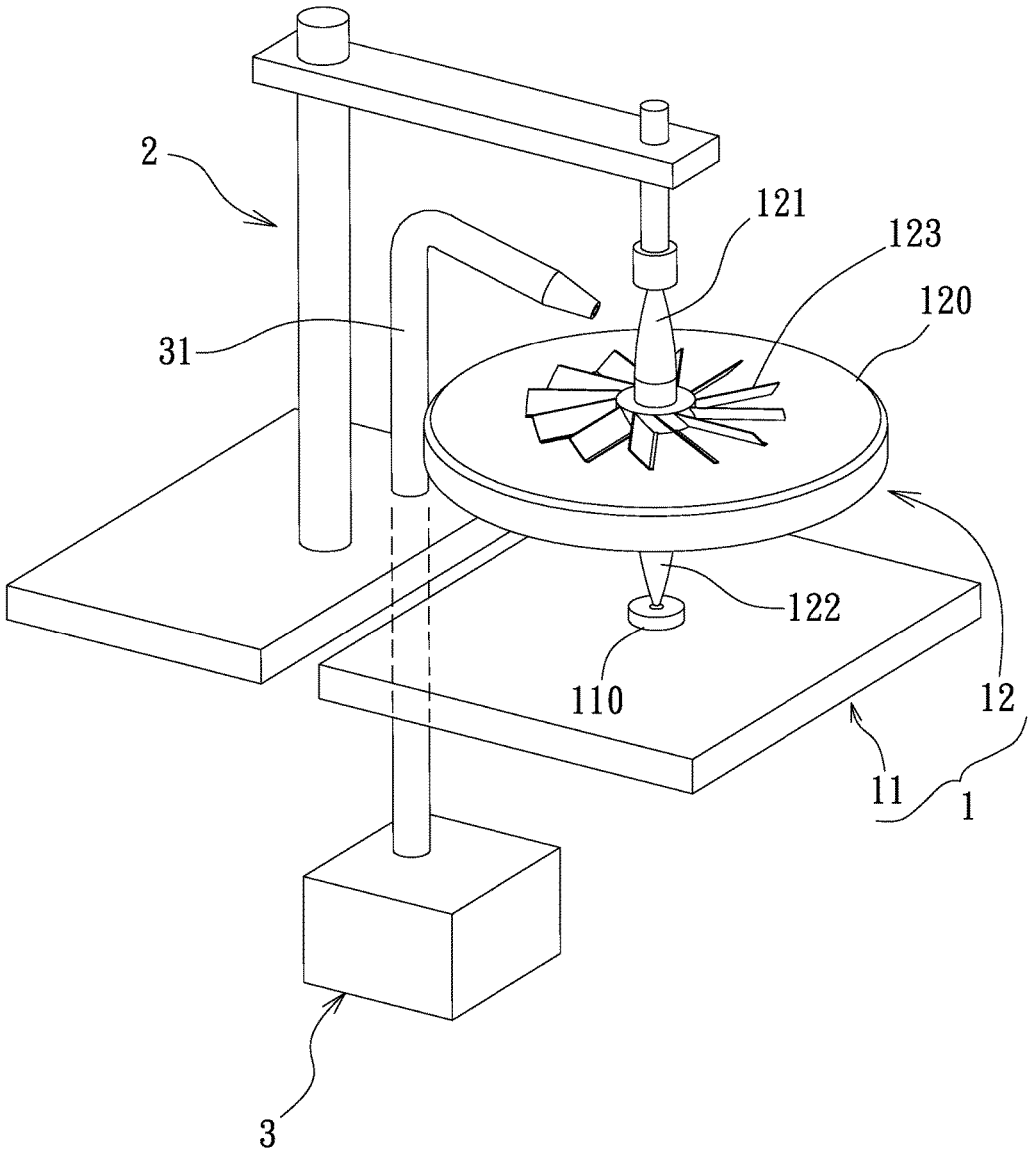
FIG. 4 shows a schematic perspective view of the spinning top assembly as shown in FIG. 1 placed next to a support and a driving device in accordance with a preferred embodiment of the present invention.
Figure 5:
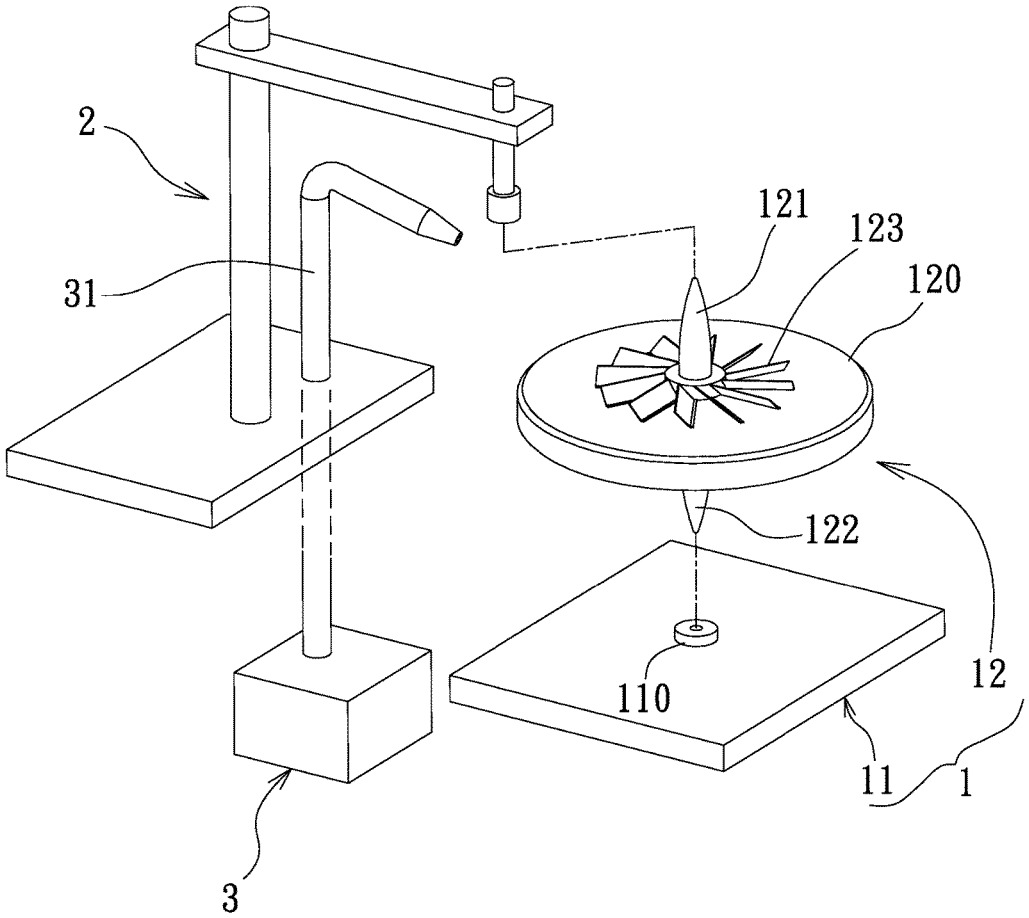
FIG. 5 shows a schematic exploded perspective view of the spinning top assembly as shown in FIG. 4 with the top of the spinning top assembly partially exploded away from a base thereof in accordance with a preferred embodiment of the present invention.

With further reference to FIG. 4 and FIG. 5, a support 2 is disposed beside the spinning top assembly 1 for temporary support of the top 12 before the top 12 starts to spin. The support 2 is either disposed separately from the base 11 or is disposed onto the base 11 directly. In the preferred embodiment, the support 2 is disposed separately from the base 11 so as to temporarily support the top 12 between the support 2 and the spin seat 110 of the base 11. The support 2 is capable of being removed to discontinue its support to the top 12 after the top 12 starts to spin and is in a stable balanced spinning condition thereof. A driving device 3 and a driving outlet 31 are also disposed beside the spinning top assembly 1. The driving outlet 31 is connected and communicated with the driving device 3 in order to convey required driving powers from the driving device 3 toward the driving structure 123 of the top 12. The driving device 3 and the driving outlet 31 are either disposed separately from the base 11 or are disposed onto the base 11 directly. In the preferred embodiment, the driving outlet 31 is disposed separately from the base 11 next to the support 2, and an end of the driving outlet 31 is pointed to the driving structure 123 of the top 12. The driving device 3 is also preferably disposed onto the base 11 at a face opposite to the surface of the base 11 in another embodiment. In the preferred embodiment, the driving device 3 is an electrical air pump or a blowing lung, and the driving outlet 31 is a conduit to convey pressurized air flows from the air pump of the driving device 3 to the plurality of fins of the driving structure 123 of the top 12. Preferably, the air pump of the driving device 3 provides flowing air and/or blowing air as a driving power to drive the driving structure 123 of the top 12, i.e., the driving power is wind power. The driving power of the air pump of the driving device 3 does not need to be applied all the time. When the top 12 spins fast enough by the driving force, spinning of the top 12 is able to continue for about a half minute to several minutes by itself with its own spinning momentum after the driving force stops. The driving power of the air pump of the driving device 3 will be required to avoid falling of the top 12 after the top 12 loses enough spinning energy and starts precession to fall.

Figure 2:
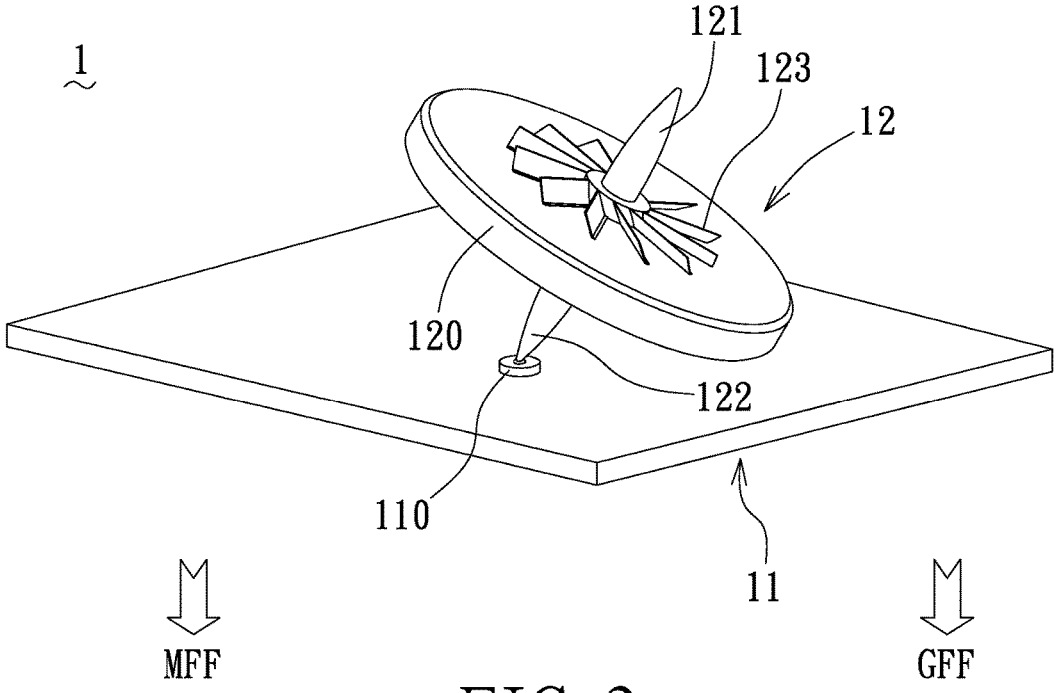
FIG. 2 shows a schematic perspective view of the spinning top assembly as shown in FIG. 1 without spinning under influence of falling forces in accordance with a preferred embodiment of the present invention.
Figure 3:
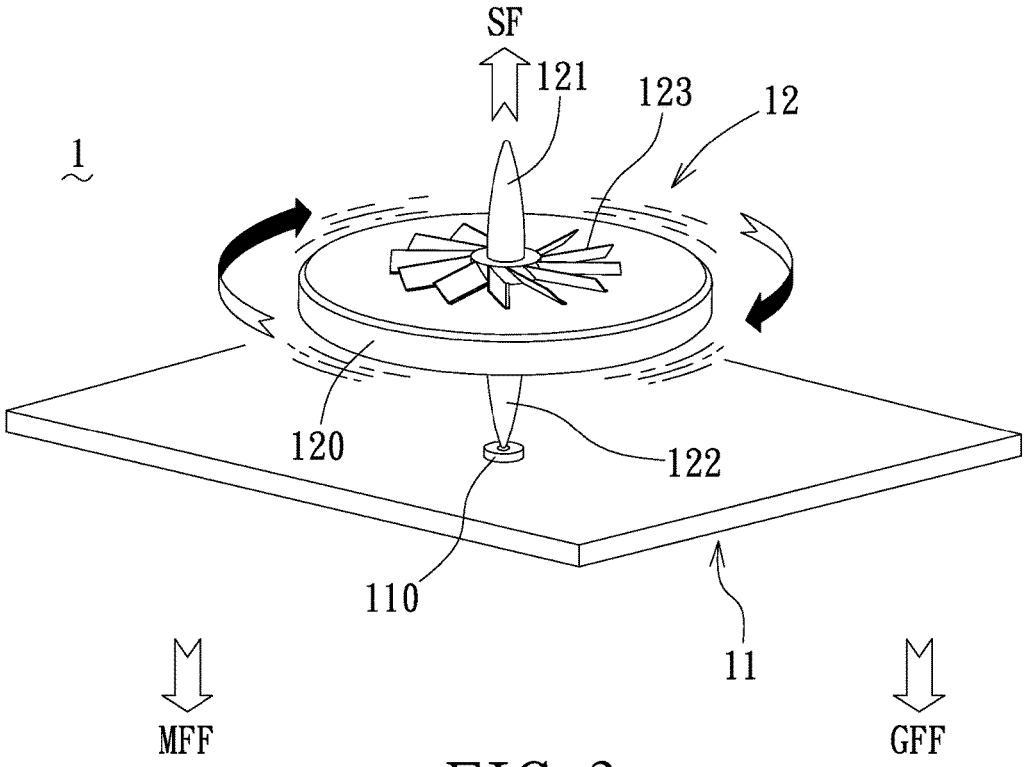
FIG. 3 shows a schematic perspective view of the spinning top assembly as shown in FIG. 1 under influence of falling forces after a top of the spinning top assembly starts to spin at a working spinning speed.
Figure 6:
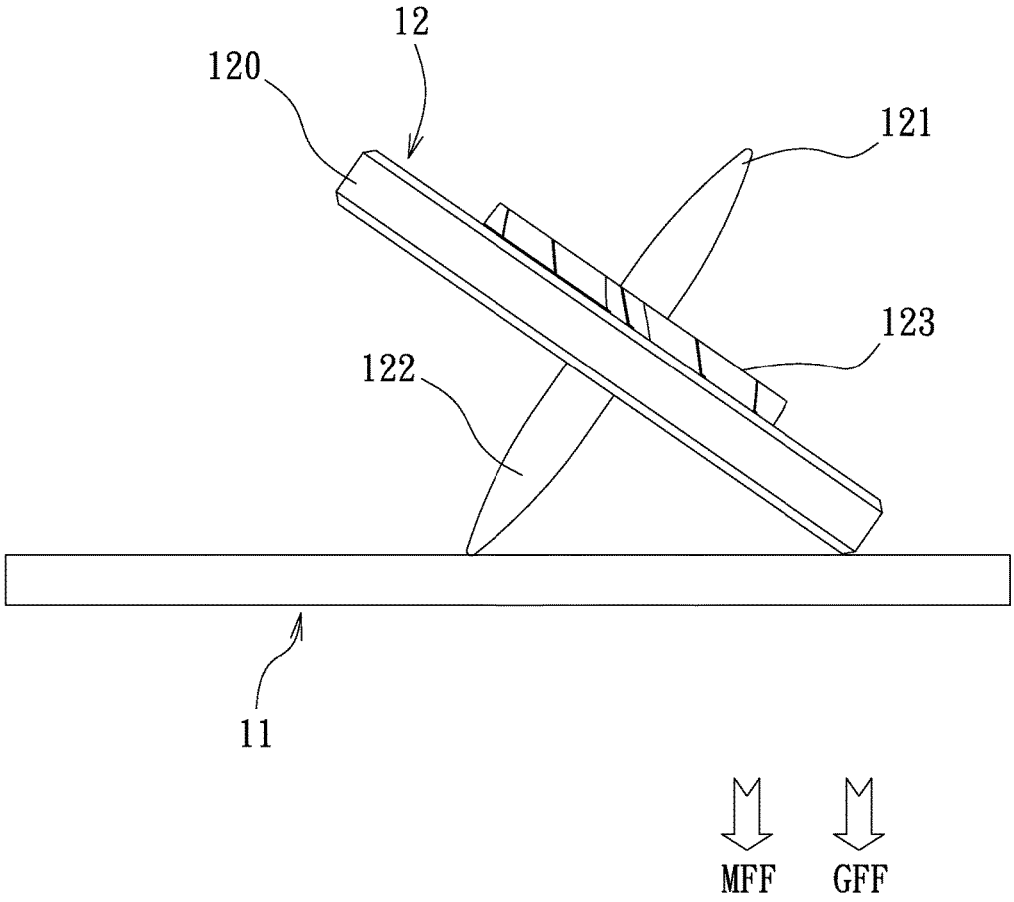
FIG. 6 shows a side view of the spinning top assembly as shown in FIG. 2 in accordance with the present invention.
Figure 7:
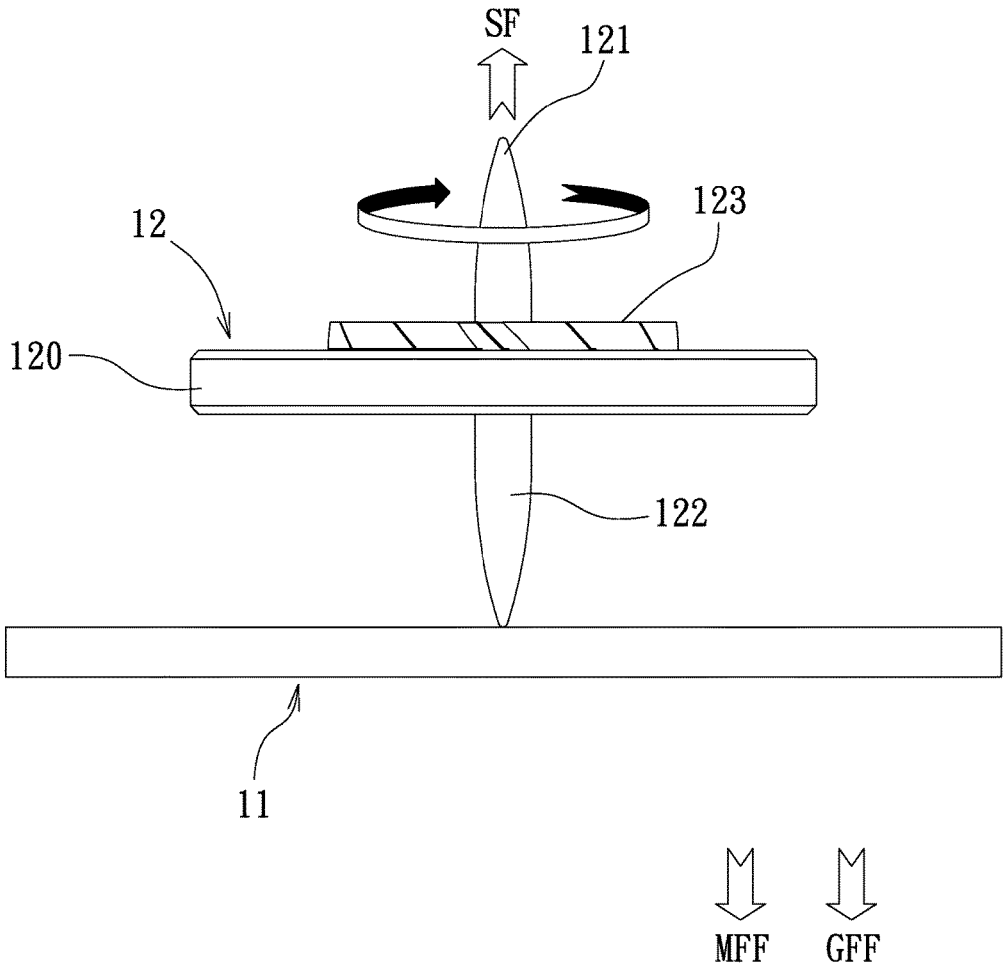
FIG. 7 shows a side view of the spinning top assembly as shown in FIG. 3 when the base is in a horizontal orientation thereof with reference to gravity after the top starts to spin at the working spinning speed under influence of falling forces.

With further reference to FIG. 2 and FIG. 6, under influence of falling forces including gravity falling force (GFF) and magnetic falling force (MFF), the top 12 of the spinning top assembly 1 is inclined onto the base 11 of the spinning top assembly 1 due to gravity influence and magnetic attraction of the base 11 while the top 12 does not spin, i.e., no standing force (SF) is generated. FIG. 6 clearly shows such status of the spinning top assembly 1 as well as FIG. 2 when the base 11 is in a horizontal orientation thereof with reference to gravity and the top 12 is static under influence of the gravity falling force (GFF) and magnetic falling force (MFF) with more than one contacting point on the base 11 and no standing force (SF) is generated. In other words, magnetic attraction of the base 11 contributes to a falling force to cause falling of the top 12. Further in FIG. 3, FIG. 4 and FIG. 7, FIG. 3 shows the spinning top assembly 1 in accordance with the present invention under influence of falling forces after the top 12 of the spinning top assembly 1 starts to spin at a working spinning speed, and shows applying directions of both of the magnetic falling force (MFF) and gravity falling force (GFF) points downward while a direction of a standing force (SF) created from spinning of the top 12 goes up. FIG. 7 shows the spinning top assembly 1 as well as FIG. 3 in which the gravity falling force (GFF) and magnetic falling force (MFF) are shown to have the same applying direction while the standing force (SF) generated from spinning of the top 12 has a direction opposite to the two falling forces. The top 12 of the spinning top assembly 1 starts to spin when the top 12 is temporarily supported between the support 2 and the spin seat 110 of the base 11, and the driving device 3 drives the top 12 to spin by its driving power via the driving outlet 31. The support 2 is then removed to disable its support to the top 12 after spinning of the top 12 is in a stable balanced condition thereof at a working spinning speed, as shown in FIG. 3 and FIG. 7. In this situation, a standing force (SF) of the top 12 is generated due to a spinning momentum and spinning energy of the top 12, and is used against the falling force to maintain spinning and an upright orientation of the top 12. Since the body 120 of the top 12 is made of magnetic response material and the base 11 is made of magnetic material providing magnetic attraction to the body 120 of the top 12, a magnetic falling force (MFF) is generated therebetween. When orientation of the base 11 varies, a direction of the magnetic falling force (MFF), which is capable of affecting a direction of the standing force (SF) for the top 12, is changed correspondingly. As a result, the spin axis and spinning orientation of the top 12 is changeable under magnetic control of the base 11 even when the top 12 is spinning.

Figure 8:
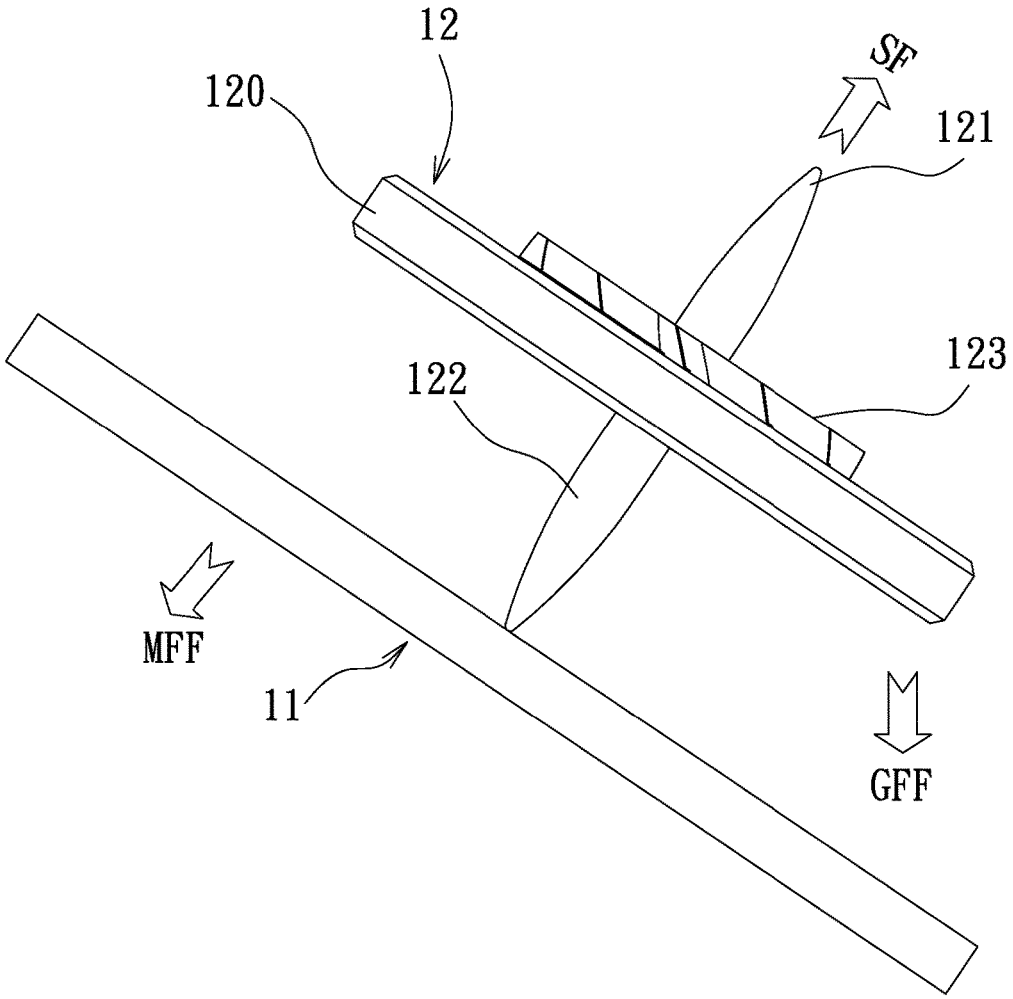
FIG. 8 shows a side view of the spinning top assembly as shown in FIG. 3 after a spin axis of the top is changed and the base is in a tilting orientation thereof under influence of falling forces.

With further reference to FIG. 3 and FIG. 7, there are two kinds of falling forces working in such circumstance, one is the gravity falling force (GFF), and the other is the magnetic falling force (MFF). Both of these two falling forces have a same downward direction as shown in FIG. 3 and FIG. 7. Under influence of the two falling forces, the standing force (SF) is upward so that the spinning top 12 can be stabilized in an upright position thereof due to balance of all forces. Such spinning stabilization of the top 12 is similar to those tops in prior art. FIG. 8 shows the spinning top assembly 1 after a spin axis of the top 12 is changed and the base 11 is in a tilting orientation thereof under influence of the falling forces when the top 12 spins at the working spinning speed under influence of a much strong magnetic falling force (MFF), which causes the spinning top 12 gradually moving to a tilted position thereof. Since the standing force (SF) should be opposite to a combination force of the magnetic falling force (MFF) and gravity falling force (GFF), and the magnetic falling force (MFF) is much stronger than the gravity falling force (GFF), the standing force (SF) is more responsive to the magnetic falling force (MFF). Hence, the magnetic falling force (MFF) has much more influence on the direction of the standing force (SF) than the gravity falling force (GFF) does because the magnetic falling force (MFF) is set to be many times stronger than the gravity falling force (GFF). When the base 11 changes from its horizontal orientation thereof with reference to gravity into a tilting orientation thereof by turning 45 degrees from the horizontal orientation thereof with respect to gravity as shown in FIG. 8, the direction of the magnetic falling force (MFF) changes along with the base 11. In the meantime, the gravity falling force (GFF) stays in the same direction as usual. At this moment, the spinning top 12 encounters two kinds of falling forces with different applying directions. As a result, the direction of the standing force (SF) is automatically set as being opposite to a combination force of these two falling forces. Since the intensity of the magnetic falling force (MFF) is preferably set to be much stronger than the gravity falling force (GFF), the standing force (SF) is more sensitive to the magnetic falling force (MFF) and the direction of the standing force (SF) is much closer to the direction of the magnetic falling force (MFF). Hence, the spinning top 12 is finally stabilized at a tilting position thereof shown in FIG. 8. At this moment, the disc body 120 of the spinning top 12 is more likely to keep a parallel relationship with the base 11. However, the body 120 is not explicitly 100% parallel to the base 11 since the gravity falling force (GFF) still has some effect on the standing force (SF) and its direction.

Figure 9A:
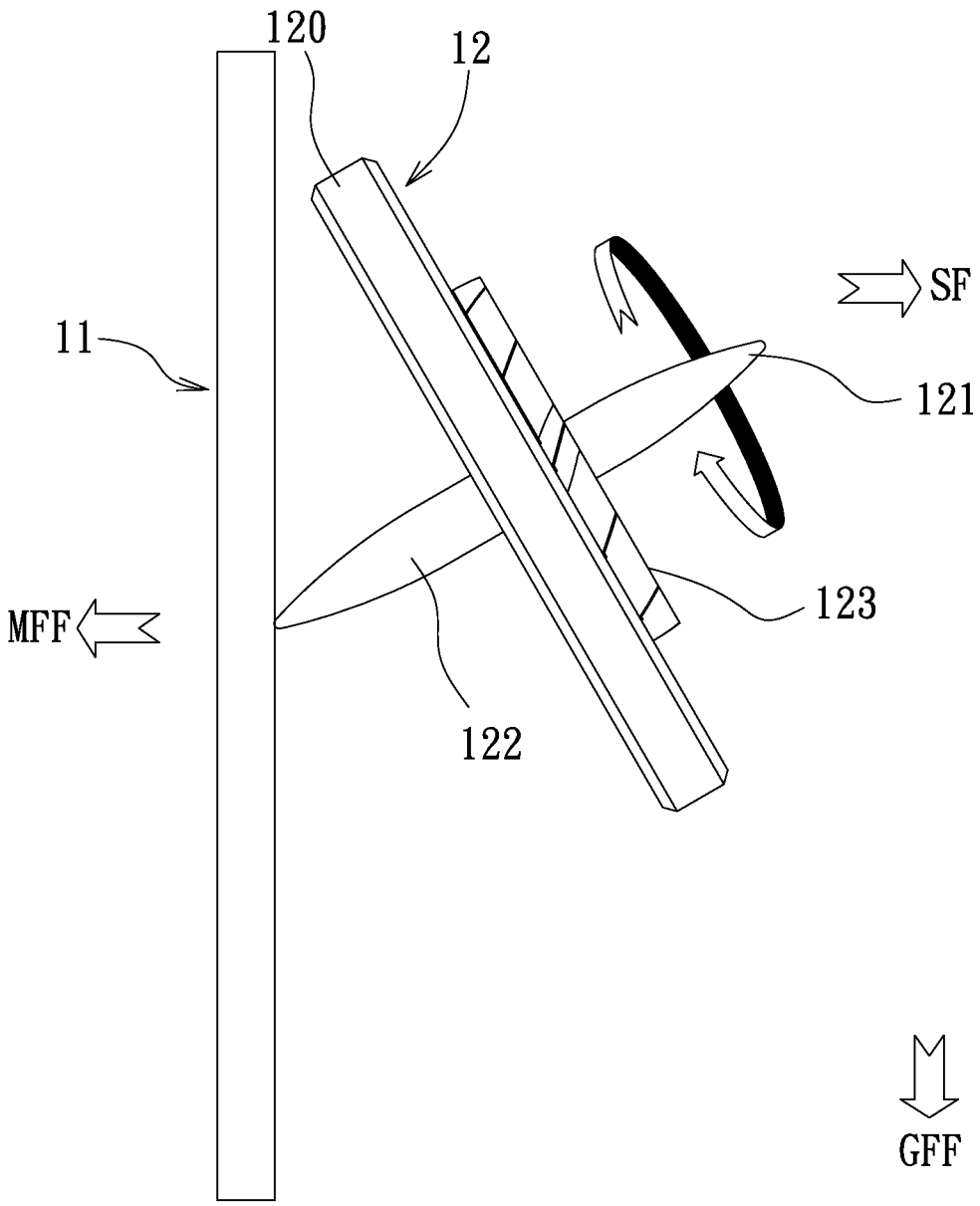
FIG. 9A shows a side view of the spinning top assembly as shown in FIG. 3 after a spin axis of the top is further changed and the base is in a vertical orientation thereof under influence of falling forces in an initial changing phase when the spinning top at the working spinning speed starts to comply with the changed spin axis thereof.
Figure 9B:
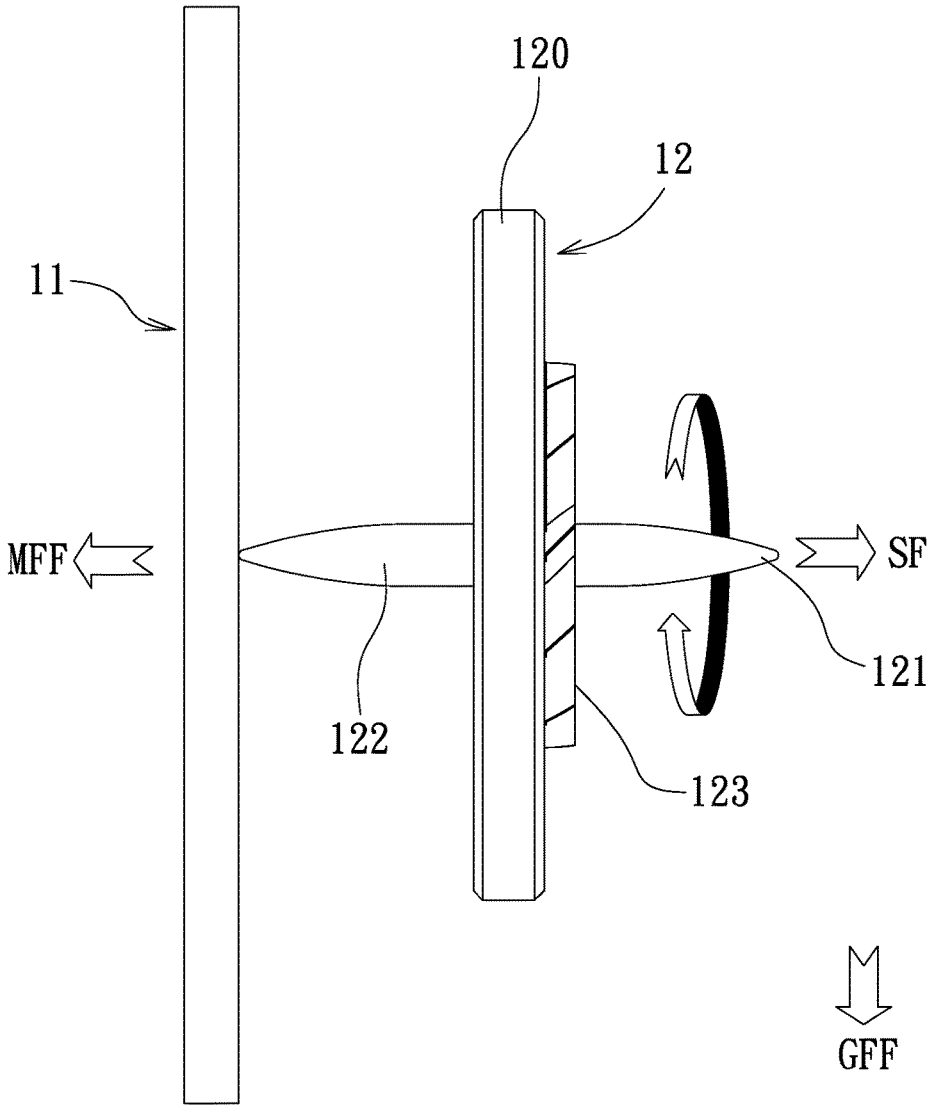
FIG. 9B shows a side view of the spinning top assembly as shown in FIG. 3 after the spin axis of the top is further changed and the base is in the vertical orientation thereof under influence of falling forces in a balance controlling phase when the spinning top at the working spinning speed reaches a stabilized status after its adjustment responsive to changing of the spin axis, and keeps a parallel relationship of the disc body with the base.

With further reference to FIG. 9A and FIG. 9B, FIG. 9A shows the spinning top assembly 1 in accordance with the present invention after a spin axis of the top 12 is further changed according to changing of the base 11 from its horizontal orientation of FIG. 7 with reference to gravity or its tiling orientation of FIG. 8 to a vertical orientation thereof under influence of falling forces in an initial changing phase when the spinning top 12 at the working spinning speed starts to comply with the changed spin axis thereof. FIG. 9B shows the spinning top assembly 1 in a balance controlling phase when the spinning top 12 at the working spinning speed reaches a stabilized status after its adjustment responsive to changing of the spin axis, and keeps a parallel relationship of the disc body 120 with the base 11. Understandably, the direction of the gravity falling force (GFF) is unchangeable in the real world. Since the magnetic falling force (MFF) is much stronger than the gravity falling force (GFF), the direction of the standing force (SF) mostly responds changing of the direction of magnetic falling force (MFF), and the direction of the standing force (SF) is subsequently altered by direction changing of the magnetic falling force (MFF). At this moment, the base 11 is further turned from the tilting orientation of FIG. 8 to a vertical orientation as shown in FIG. 9B. The disc body 120 of the spinning top 12 follows turning of the base 11 and gradually moves to a vertical position thereof accordingly. Apparently, the magnetic falling force (MFF) has a direction pointing toward the left hand side of FIG. 9B and the standing force (SF) has a direction pointing toward the right hand side. Since the applying direction of the gravity falling force (GFF) always stays the same, combinative balance between the magnetic falling force (MFF), the gravity falling force (GFF) and the standing force (SF) clearly keeps the spinning top 12 from falling off the base 11 and continuing spinning of the top 12 on the base 11 in the air without any proper support. This is the reason how the spinning top assembly 1 of the present invention defies gravity during spinning of the top 12.

Figure 10:
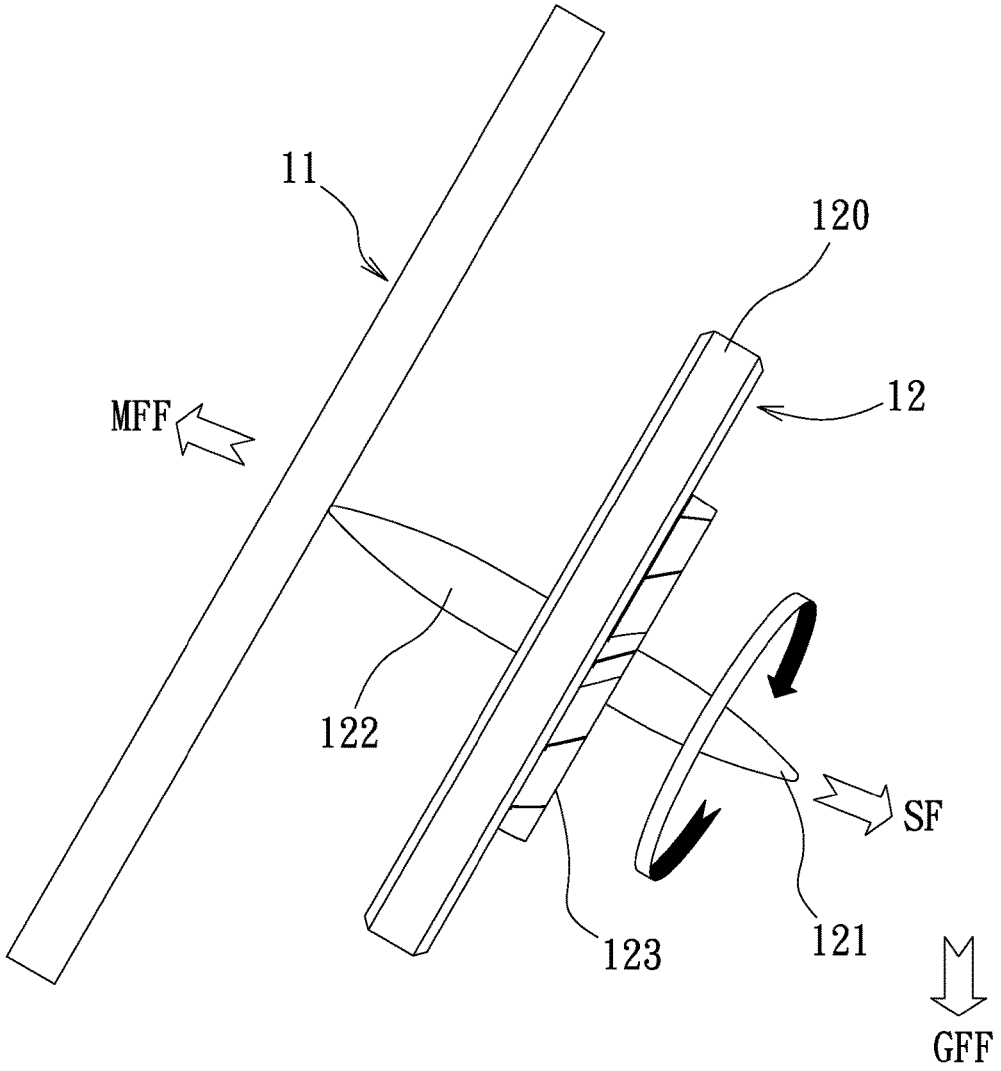
FIG. 10 shows a side view of the spinning top assembly as shown in FIG. 3 after the spin axis of the top is further changed and the base is in a bevel orientation thereof under influence of falling forces.
Figure 11:
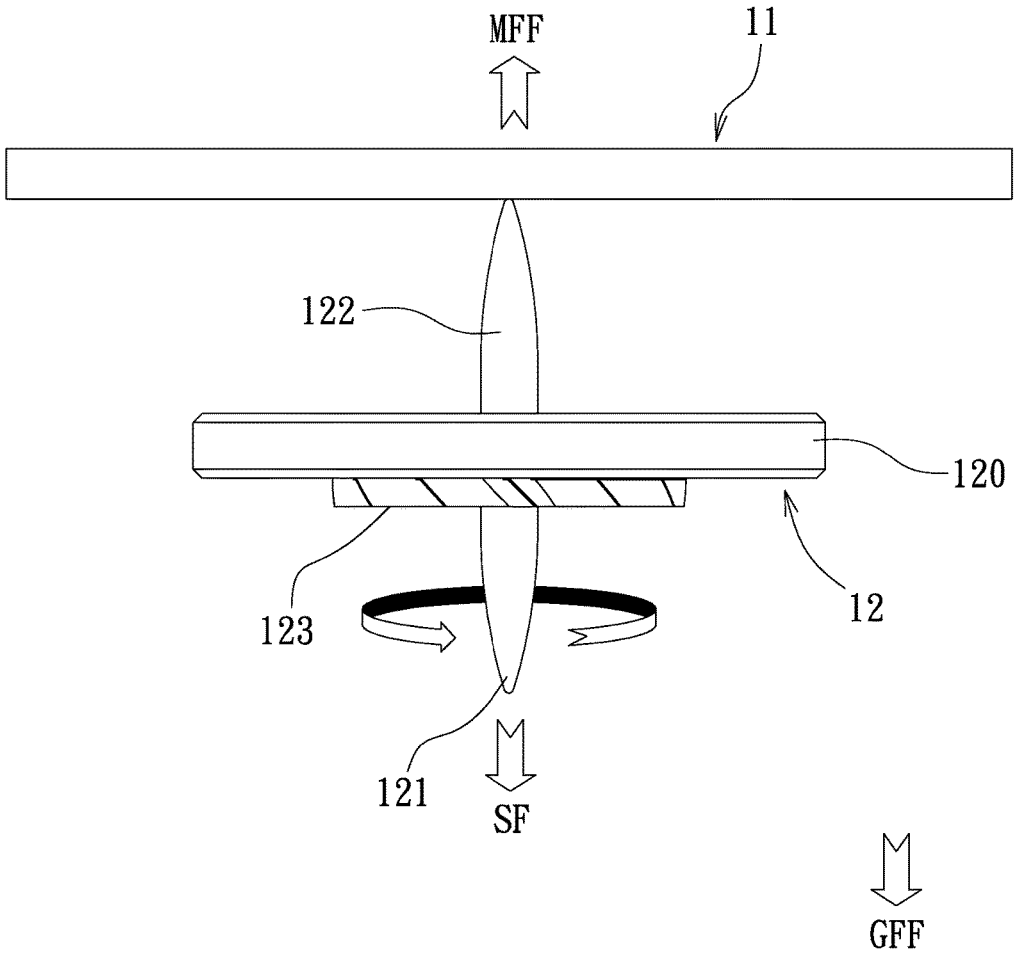
FIG. 11 shows a side view of the spinning top assembly as shown in FIG. 3 after the spin axis of the top is further changed and the base is in an upside-down orientation thereof under influence of falling forces.

In other words, when orientation of the base 11 varies, for example, from the horizontal orientation of the base 11 to a vertical orientation of the base 11 as shown in FIG. 9A and FIG. 9B, the magnetic attraction of the base 11 to the body 120 of the top 12 will gradually change the spin axis of the top 12 from a parallel direction to gravity to a vertical direction to gravity due to spinning of the top 12, i.e., the disc body 120 gradually moves from its horizontal position with regard to gravity to its vertical position with regard to gravity. In FIG. 9A, the top 12 continues its spinning and the spin axis of the top 12 inclines slowly from the parallel direction to gravity in an initial changing phase because of gravity and spinning momentum of the top 12. In FIG. 9B, the spin axis of the top 12 continues inclination thereof under magnetic control of the base 11 until the spin axis of the top 12 is completely changed to the vertical direction to gravity as shown in FIG. 9B. In such circumstance, the magnetic attraction of the base 11 to the body 120 of the top 12 will also balance gravity and spinning of the top 12 continues by defying gravity even though no support to the top 12 is available anymore. Similar situations can be found in other orientations of the base 11 after spinning of the top 12 is in the stable balanced condition thereof as shown in FIG. 3 and FIG. 7. Especially, as shown in FIG. 10, the orientation of the base 11 varies from the horizontal orientation thereof to a bevel orientation thereof by turning 135 degrees from the horizontal orientation thereof with respect to gravity. In this situation, the magnetic falling force (MFF) has a direction pointing toward the left upper corner of FIG. 10 and the standing force (SF) has a direction pointing toward the right lower corner. The top 12 will keep its stable balanced spinning without interrupt due to the above mentioned magnetic attraction from the base 11 by wobbling to change its spin axis gradually under magnetic control of the base 11. The top 12 continues spinning on the base 11 even for applying of the gravity falling force (GFF). Furthermore, as shown in FIG. 11, the orientation of the base 11 varies from the horizontal orientation thereof to an upside-down orientation thereof by turning 180 degrees from the horizontal orientation thereof with respect to gravity. In this situation, the top 12 will keep its stable balanced spinning without interrupt due to the above mentioned magnetic attraction from the base 11. Even though the spinning top 12 spins upside-down in FIG. 11, the spinning top 12 is still considered as being standing since there is only one contacting point between the base 11 and the spinning top 12.

With reference back to FIG. 8, assuming the base 11 is equipped with an electromagnet, the magnetic falling force (MFF) will be removed from the base 11 by turning off electrical power of the electromagnet. In this situation, the only falling force left for the spinning top 12 is the gravity falling force (GFF). In the real world, the applying direction of the gravity falling force (GFF) always goes downward. Hence, the direction of the standing force (SF) has to change from its tilting direction pointing toward the right upper corner of FIG. 8 to an upward direction opposite to the applying direction of the gravity falling force (GFF). Under cooperative influence of the standing force (SF) and the gravity falling force (GFF), the spinning top 12 moves back to its upright position even though the base 11 is kept in its tilting orientation. In this situation, spinning of the top 12 and the top itself will not be controllable, i.e., the top 12 spins on its own in response to the gravity falling force (GFF) without influence of the magnetic falling force (MFF) as applied in FIG. 8, and the spinning top 12 fails to change its orientation together with the base 11 simultaneously. Hence, without help of the magnetic falling force (MFF) from the base 11 as applied in FIG. 8, the top 12 may fall off the base 11 immediately while spinning due to the only influence of the gravity falling force (GFF) and fails to defy gravity as the present invention.

Described above is based on using the principle of stereoscopic display systems supporting the side-by-side format, and this is only used for explanation and description of a preferred embodiment of the present invention. Where those skilled in this art can make all sorts of other change or improvements based on the above description, the changes or improvements are still covered within the inventive spirit of the present invention and the scope as defined in the following claims.

What is claimed is:

1. A spinning top assembly, comprising:

a base generating magnetic attraction to ferrous metal material, a flat face of the base defined at a side of the base and the flat face defining a direction orthogonal to the flat face and away from the flat face, the base being capable of turning to at least a first orientation thereof where a first included angle is defined between the defined direction of the flat face of the base, and a direction of gravity, and a second orientation thereof where a second included angle is defined between the defined direction of the flat face of the base and the direction of the gravity, wherein the first included angle is different from the second included angle; and a top comprising a disc body made of ferrous metal material, the body defining a first surface for magnetic attraction of the base applying thereon facing the base to be parallel to the flat face of the base when the top spins, and a shaft extending from the body to the flat face of the base so as to engage on the flat face of the base, the top spinning on the flat face of the base via the shaft after the top spins in a stable balanced condition and subsequently the base is turned from the first orientation thereof to the second orientation thereof.

2. The spinning top assembly as claimed in claim 1, wherein the shaft of the top comprises an upper shaft extending away from the face of the base and a lower shaft extending toward the face of the base.

3. The spinning top assembly as claimed in claim 2, wherein the upper shaft and the lower shaft are integrally formed with the body of the top and are aligned to each other to be commonly defined as the shaft.

4. The spinning top assembly as claimed in claim 1, wherein a second surface is defined on the body facing away from the base, a driving structure is defined on the second surface of the body and is used to receive outside driving powers for spinning of the top.

5. The spinning top assembly as claimed in claim 4, wherein the driving structure comprises a plurality of fins.

6. The spinning top assembly as claimed in claim 5, wherein each of the plurality of fins extends along the face of the base from the shaft to an edge of the base.

7. The spinning top assembly as claimed in claim 4, wherein the driving powers are wind power and are caused by flowing air.

8. The spinning top assembly as claimed in claim 7, wherein the flowing air is generated from one of an electrical air pump and a blowing lung.

9. The spinning top assembly as claimed in claim 1, wherein a driving structure is defined on the first surface of the body and is used to receive outside driving powers for spinning of the top.

10. The spinning top assembly as claimed in claim 1, wherein a spin seat is disposed on the face of the base to receive an end of the shaft for spinning of the top.

* * * * *